US007841136B2

(12) United States Patent
Czyznikiewicz

(10) Patent No.: US 7,841,136 B2
(45) Date of Patent: Nov. 30, 2010

(54) SHELTER PAC

(76) Inventor: Ronald Chester Czyznikiewicz, 14221 SE. 88th Ter., Summerfield, FL (US) 34491

( * ) Notice: Subject to any disclaimer, the term of this patent is extended or adjusted under 35 U.S.C. 154(b) by 433 days.

(21) Appl. No.: 11/732,069

(22) Filed: Apr. 2, 2007

(65) Prior Publication Data

US 2007/0245637 A1 Oct. 25, 2007

(51) Int. Cl.
*E04B 3/343* (2006.01)
*E04B 1/344* (2006.01)

(52) U.S. Cl. ..... 52/71; 52/64; 52/66; 52/69

(58) Field of Classification Search ..... 52/64, 52/66, 68, 69, 70, 71, 79.1, 79.5; 16/271, 16/272, 345
See application file for complete search history.

(56) References Cited

U.S. PATENT DOCUMENTS 2,765,499 A * 10/1956 Couse ..... 52/66
4,633,626 A * 1/1987 Freeman et al. ..... 52/71
4,635,411 A * 1/1987 Kurzen ..... 52/71
4,741,133 A * 5/1988 Kutzner ..... 52/79.5
5,345,730 A * 9/1994 Jurgensen ..... 52/64
5,461,832 A * 10/1995 Smith ..... 52/69
5,596,844 A * 1/1997 Kalinowski ..... 52/79.5
5,964,065 A * 10/1999 Migurski et al. ..... 52/64
5,966,956 A * 10/1999 Morris et al. ..... 62/259.1
6,253,500 B1 * 7/2001 Gyllenhammar ..... 52/79.5
6,434,895 B1 * 8/2002 Hosterman et al. ..... 52/143
6,983,567 B2 * 1/2006 Ciotti ..... 52/79.5
2009/0044460 A1 * 2/2009 Medley ..... 52/71

FOREIGN PATENT DOCUMENTS

JP 05033395 * 2/1993

* cited by examiner

*Primary Examiner*—Phi Dieu Tran A
(74) *Attorney, Agent, or Firm*—Defillo & Associates, Inc.; Evelyn A. Defillo

(57) ABSTRACT

The proposed invention relates to a portable housing/shelter unit assembled in a manufacturing building, loaded on a trailer truck and delivered to a site. Once on the site it is lifted off the trailer and lowered onto a leveled ground location or a foundation. Then the unit is un-folded from its central frame (container) and secured to the foundation and final extrusions and screws are applied; thus, the unit is setting in final set up position, structurally and weather tight. If required, additional exterior fenestration can be added to the basic shell, and the exterior customized per client needs and directives.

6 Claims, 11 Drawing Sheets

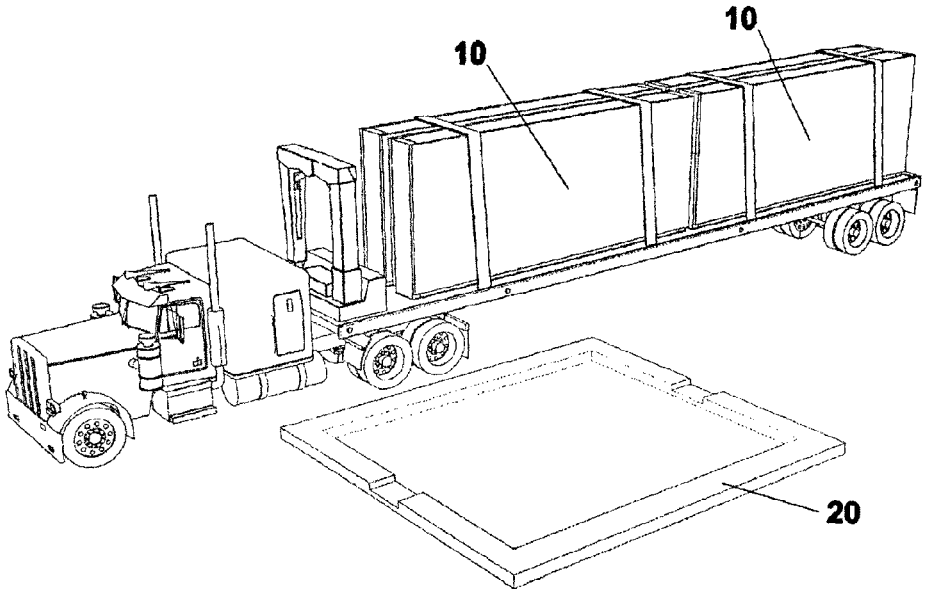
FIGURE #1
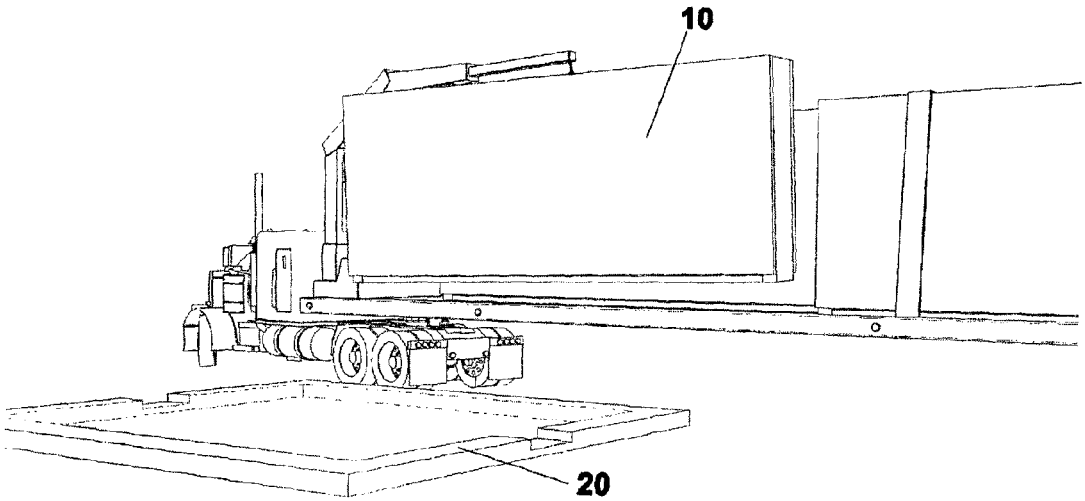
FIGURE #2

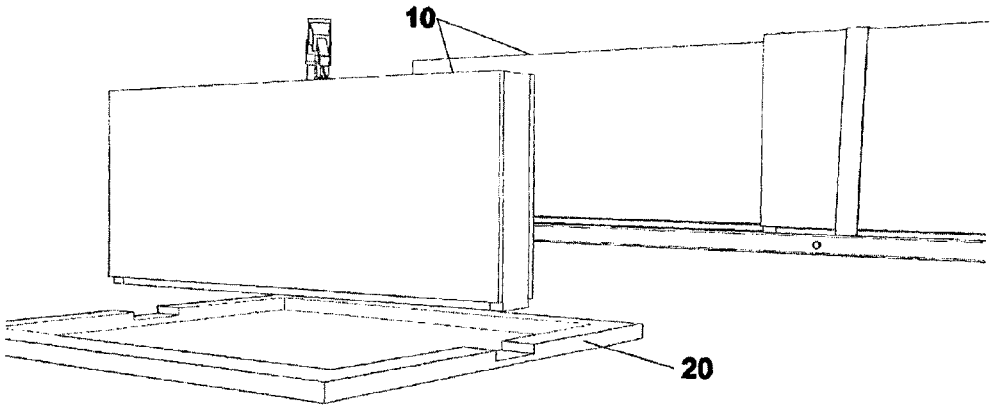
FIGURE #3
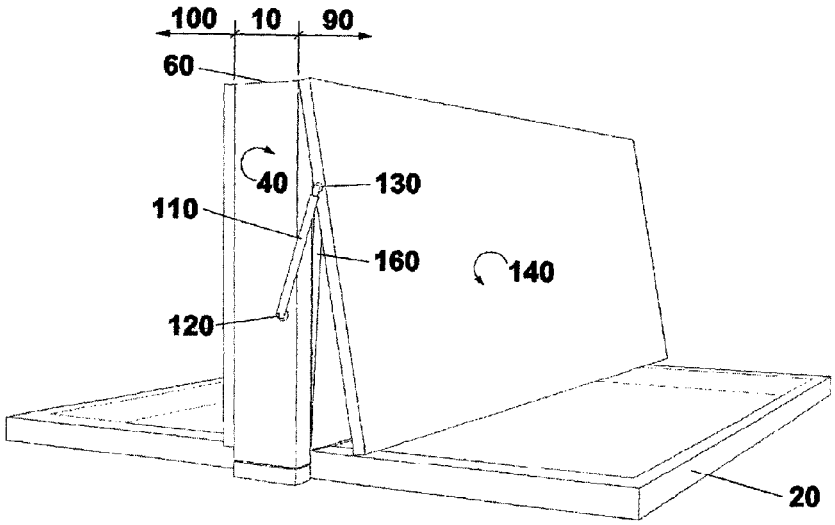
FIGURE #4

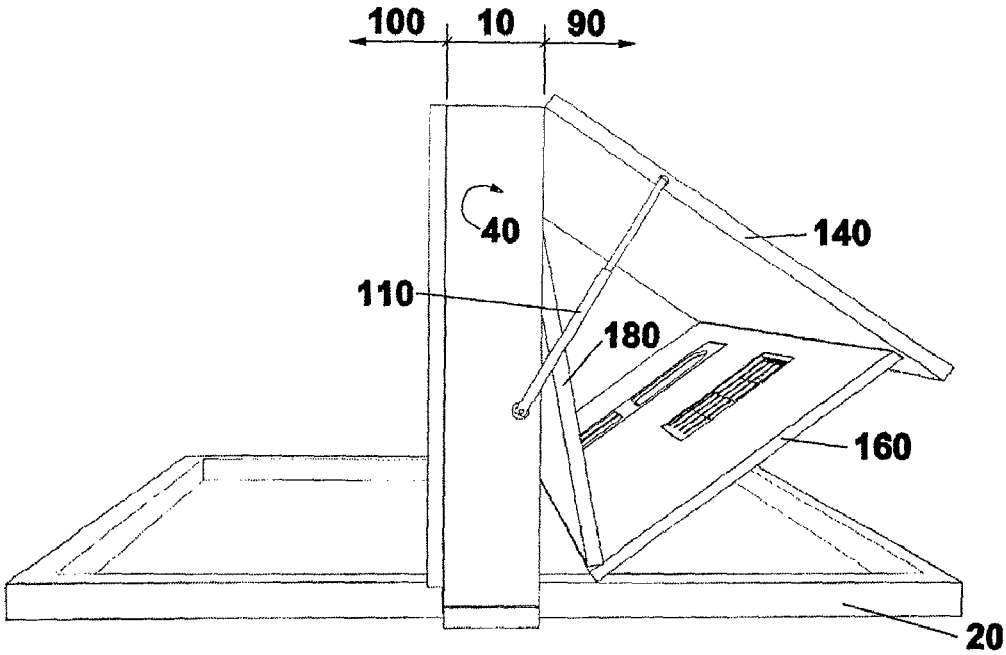
FIGURE #5
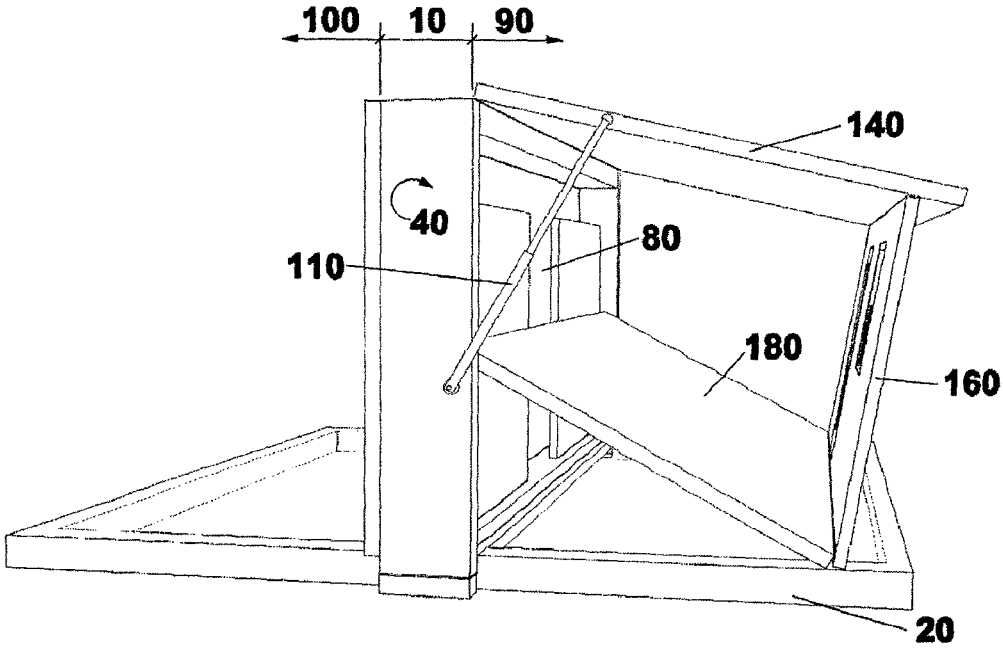
FIGURE #6

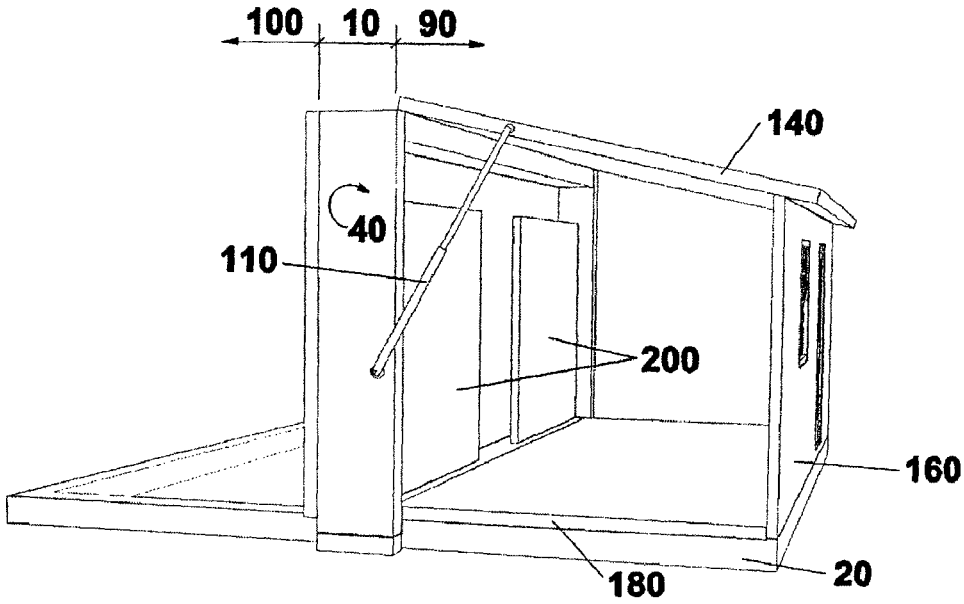
FIGURE #7
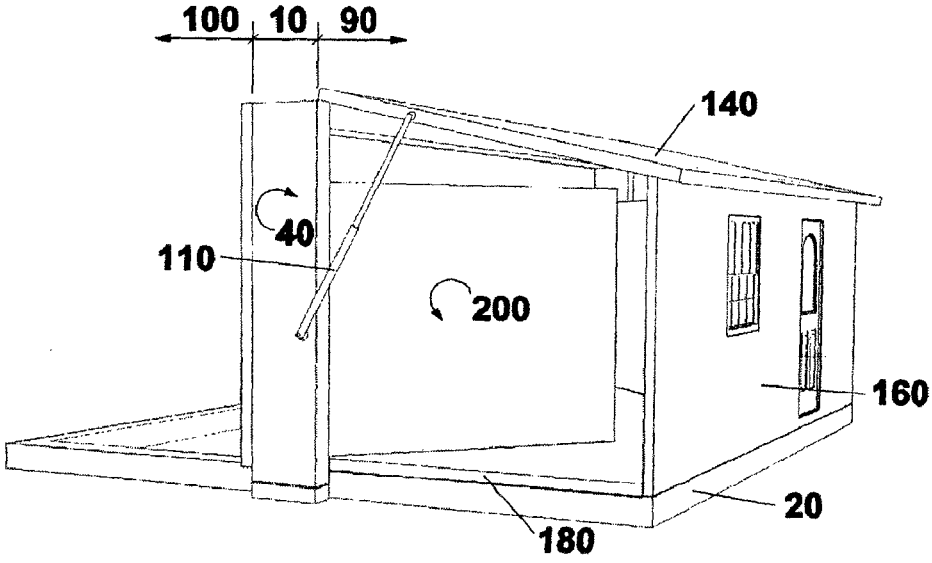
FIGURE #8

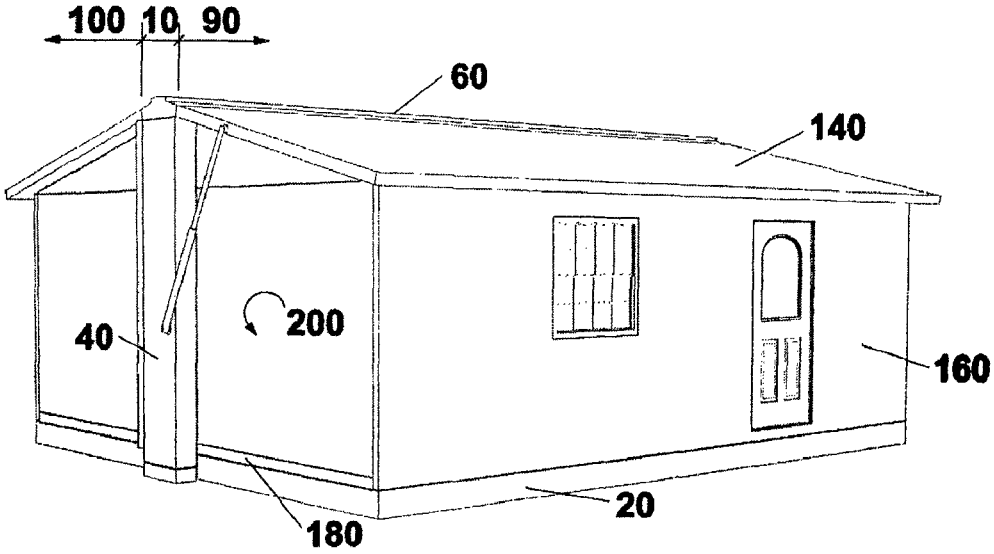
FIGURE #9
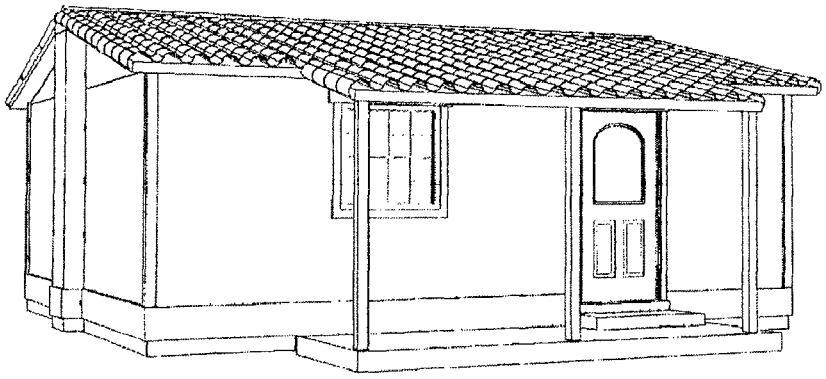
FIGURE #10

2 bedroom unit 638 sq. ft. +/-

3 bedroom unit 900 sq. ft. +/-

ShelterPac

SHELTER PAC

TECHNICAL FIELD

The present invention relates to a foldable and portable shelter or housing unit, and more specifically to a shelter or housing unit that can be converted automatically from a foldable inoperative position to an unfolded operative position through the use of mechanical or manpower actuators.

BACKGROUND OF THE INVENTION

The use of temporary or semi-permanent shelters or low income/affordable housing units has increased in view of situations such as natural disasters, resettlement, overpopulation in economically disadvantaged regions, military applications to house personnel and equipment, temporary accommodations on construction sites, and the need for space in special social events and exhibitions.

The prior art teaches the use of prefabricated portable shelters or housing units for use in applications where immediate shelter and protection for persons and property is required. Unfortunately, the portable shelters or housing units of the prior art suffered from many disadvantages.

The main disadvantage is the limited transportability of such shelters or housing units. Transporting the prefabricated structures to the desired site can pose difficulties. This is due to the fact that the structures are very large (shipping volume) and require transportation means specially adapted to transport them.

As a result of the necessity for special transportation means, the cost for obtaining the special permits required for moving the oversized structures, and the inaccessibility of the roads to the special vehicles needed to transport the structures, the transportation of the prefabricated structures of the prior art can be quite expensive.

Another disadvantage is the time and effort required to un-pack, assemble, and mount the prefabricated structure onto the foundation. Typically, large cranes, jacks, lifting devices, customized tools, and skilled crews must be used to set the unit and then to unfold partial walls, roof, and floor of the structure. Once erected, further assembly and construction is often required to make it structural and weather tight.

Another disadvantage of the known prefabricated shelters of the prior art is that they require the connection of different panels by using conventional permanent fastening means, including nails, nuts and screws and the like. The use of permanent fasteners often make it inconvenient to knock down, dissemble the structure for removal and if required relocated to a different site; thus, it is not very portable, and often result in the loss of some of the parts used to refasten or connect the various parts at a new site. Furthermore, assembling the structure in the field requires special tools, which sometimes are not readily available from one site to another site.

Frequently, a need arises for a large number of structures to be rapidly erected in a given location. These requirements are often the result of natural disasters such as floods or earthquakes, hurricanes, and in some instances war. In these exigencies, rapid response is critical. The prior art prefabricated shelters require a lot of storage space. Due to their size and manner of construction, storing a large number of ready to use shelters according to the prior art is complicated.

The present inventor thought of the necessity of storing a large number of units in a relatively small space; thus, making them ready for quick transport to the desired site. In addition, the present inventor thought of the necessity of providing a prefabricated shelter which is relatively easy to assemble and reduces the amount of manpower needed to assemble the structure, and in most cases non-skilled labor is required.

SUMMARY OF THE INVENTION

It is a primary objective of the present invention to provide a prefabricated shelter or housing unit which can be storage/folded to reduce the storage and transporting space.

It is yet another objective of this invention to provide a shelter or housing unit which is easier to transport than the prefabricated structures of the prior art.

Another objective of the present invention is to provide a prefabricated shelter or housing unit which is relatively easy to assemble and reduces the amount of skilled manpower needed to assemble the structure. Skilled manpower is hard to find in today's technical word, both in the United States of America and foreign countries.

It is yet another objective of this invention to provide a shelter or housing unit which can be joined together in an end-to-end or side-by-side relation so that the total confined sheltered space can be extended or increased.

The present invention provides a cost effective way to provide shelter for victims of natural or man-made disasters, or for other users wherein quick assembly of the shelter is important. Also, because of cost efficiency, low income or affordable housing can be a key market.

The structure of the present invention is capable of assembly under adverse conditions with little or no instruction and expertise. Construction is quickly and easily accomplished, with small tools or implements, i.e.: screwdrivers, optionally drill/driver, etc.

The present invention relates to a portable housing unit that can be placed on level ground or foundation. The portable housing unit comprising:

- a central frame having a first side, a second side, a top side, a bottom side, and a hollow interior core creating a surrounding frame, wherein the first end and second end define opposing ends of the frame;
- a first section attached to the first side of the central frame;
- a second section attached to the second side of the central frame;
- a removable mechanical actuator for unfolding the unit, wherein the mechanical actuator includes a first end and a second end, wherein the first end of the mechanical actuator is connected to the central frame;

wherein each of the first and second sections comprise:

a) a roof panel hinge attached to the top side of the central frame, wherein the roof panel includes a guide rail on each side extending along a majority of the length of said roof panel, wherein the second end of the mechanical actuator is connected to the roof panel;

b) a side wall panel connected to the roof panel, the side panel having a pivot roller mounted to the top side of the panel, and inserted into the guide rails of the roof panel;

c) a floor panel connected to the side wall by a continuous hinge and connected to the central frame by means of a pivot roller mounted to the side of the floor panel, and inserted into a guide rail, wherein the guide rails are located on the inside face of the central frame;

d) a pair of end panels with pivots on the top and bottom, connected to the central frame;

- wherein the panels are stored within the volume of space defined by the surrounding frame in the folded/stored position; and
- wherein the first section of the housing unit is unfolded on the ground or foundation by:

1) activating the mechanical actuator, which extends the roof panel outward causing the panel to swing upward, the side wall to slide outward and down and diagonally along the roof guide rails via pivot roller, then the floor panel slides downward along the guide rails located in the end sections of the central frame via pivot roller and comes to rest horizontally on the ground or foundation, then the pair of end panels swing out toward the sides and into the end wall position; and 2) switching the mechanical actuator to the second section and activating the mechanical actuator on the second section to repeat the process and create the second section by means as mentioned above.

Furthermore, the portable housing unit, according to the present invention, contemplates the use of a hydraulic or pneumatic means as the mechanical actuator.

In another embodiment, the present invention contemplates replacing the hydraulic or pneumatic means by physical manpower to lift the roof and thus un-fold the sections.

In this embodiment, the portable housing unit to be placed on a ground comprises:

a central frame having a first side, a second side, a top side, a bottom side, and a hollow interior core which creates a surrounding frame, wherein the first end and second end define opposing ends of the central frame;

a first section attached to the first side of the central frame;

a second section attached to the second side of the central frame;

an external force for unfolding the unit;

wherein each of the first and second sections comprise:

a) a roof panel hinge attached to the central frame, wherein the roof panel includes guide rails on each side extending along a majority of the length of said roof panel;

b) a side wall panel connected to the roof panel, the side panel having a pivot roller attached to the guide rails of the roof panel;

c) a floor panel connected to the side wall by a continuous hinge and connected to the central frame by means of a pivot roller mounted to the sides of the floor panel, and inserted into the guide rails located on the inside face of the central frame ends;

d) a pair of end panels top and bottom with pivots connected to the central frame;

wherein the panels are stored within the volume of space defined by the surrounding frame in the folded/stored position; and wherein the first section of the housing unit is unfolded on the ground or foundation by:

1) applying the external force on the first section, which extends the roof panel outward causing the panel to swing upward, the side wall to slide outward and downward horizontally along the roof guide rails via pivot rolls, then the floor panel slides downward and comes to rest horizontally on the ground or foundation, then the pair of end panels swing out toward the sides and into the end wall position; and 2) applying the external force to the second section and activating the mechanical actuator on the second section to repeat the process and create the second section.

Once assembled, in the manufactured building, the structure is loaded on a truck(s), shipping container(s), boat, rail, or other transporting means. Then, the structure is delivered to the desired destination.

In one embodiment of the present invention, the assembled structure is about 21 to 30" wide×120-144" high×about 20' to 32' long. Being that the unit is only 21 to 30" wide, it allows the stacking of up to six units on a standard semi-truck trailer with a forty foot bed or longer as required for the final unit length.

Please note that the unit according to the present invention is not limited by any size. The size of the unit will depend on the needs of the market/consumer.

The basic concept is to lift the portable housing unit by means of a small crane or delivery truck with incorporated lifting device or similar equipment and set the unit on the ground or foundation. Then the mechanical actuator is activated to automatically unfold the unit from the main central frame and storage container.

With all the components in place, various securing extrusions, anchors, and sealants are set in place, assuring that the building is structurally sound and weather tight.

Electrical wiring, plumbing pipes, and HVAC runs can be tied in, extended, and secured in final placement. The unit is erected. The next phase, if applicable, is to add some finishing touches to the unit such as cabinets, doors/trim, carpet/vinyl, fan and light fixtures, bathroom fixtures and miscellaneous accessories. Exterior finishes can also be added. But, the basic unit is pre-finished/pre-painted and additional finishing is not required.

The design of the present invention allows the structure to be shipped efficiently and cost effectively in its folded form. When multiple structures are being sent to a single location, the mechanical actuator may be removed from one structure and quickly installed and reused in a plurality of structures, thereby minimizing the effective cost of each structure.

The shelter or housing unit, according to the present invention, is not subject to a single one time use. It is easily dismantled and pre-assembled, such that a structure is capable of storage in a small container shipped to a new location and re-assembled. This is not only cost effective, but aids storage.

It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

For a fuller understanding of the nature and objectives of the invention, reference should be made to the following detailed description taken in connection with the accompanying drawings in which:

FIG. 1 illustrates a perspective view of the transportation vehicle loaded with several units of the shelter or structures according to the present invention.

FIG. 2 illustrates a perspective view of the transportation vehicle showing the vehicle's lifting device grabbing a folded unit.

FIG. 3 illustrates a perspective view of the transportation vehicle showing the vehicle's lifting device placing the folded unit on the ground or foundation.

FIG. 4 illustrates that when the actuator is activated and the roof panel starts raising outward and upward.

FIG. 5 illustrates that when the roof panel is extended upward, the sidewall panel slides downward and then the floor panel starts sliding downward.

FIG. 6 illustrates that when the floor panel continues to slide downward, the weight of the floor panel along with gravity, contributes to lever-up the sidewall and also the roof panel.

FIG. 7 illustrates that when the unit having the roof, side-wall and floor set in final position.

FIG. 8 illustrates the end walls pivoted into position to form the ends of the first half of the unit.

FIG. 9 illustrates the assembled shelter or housing unit according to the present invention after the second half of the unit is being completed.

FIG. 10 illustrates the shelter or housing of the present invention including optional elements added after the assembly.

DETAILED DESCRIPTION OF THE PREFERRED EMBODIMENT

Figure 11:
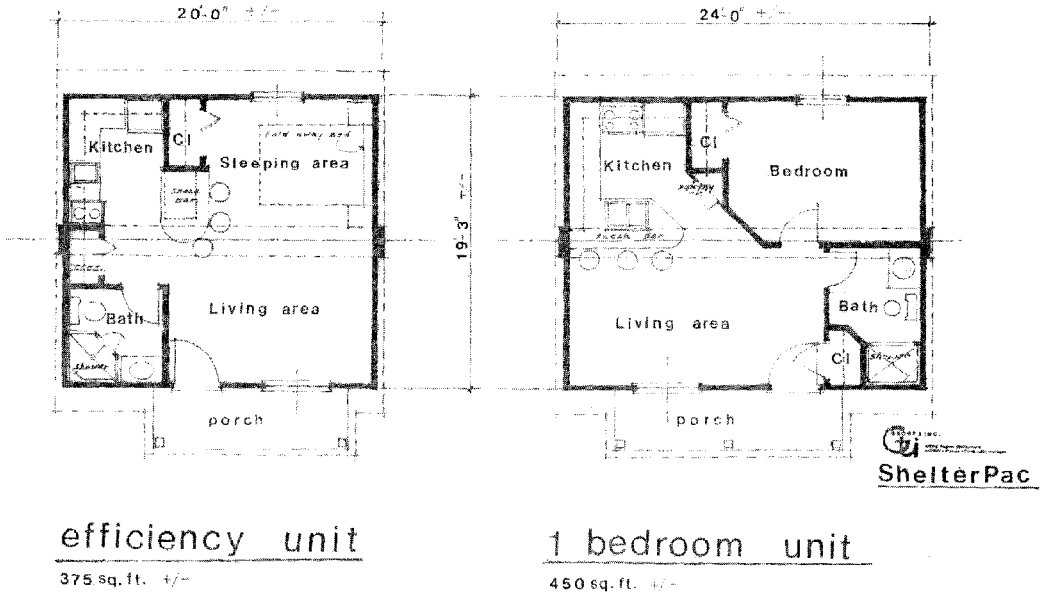
FIG. 11 illustrates one embodiment of the present invention showing a one bedroom unit.
Figure 12:
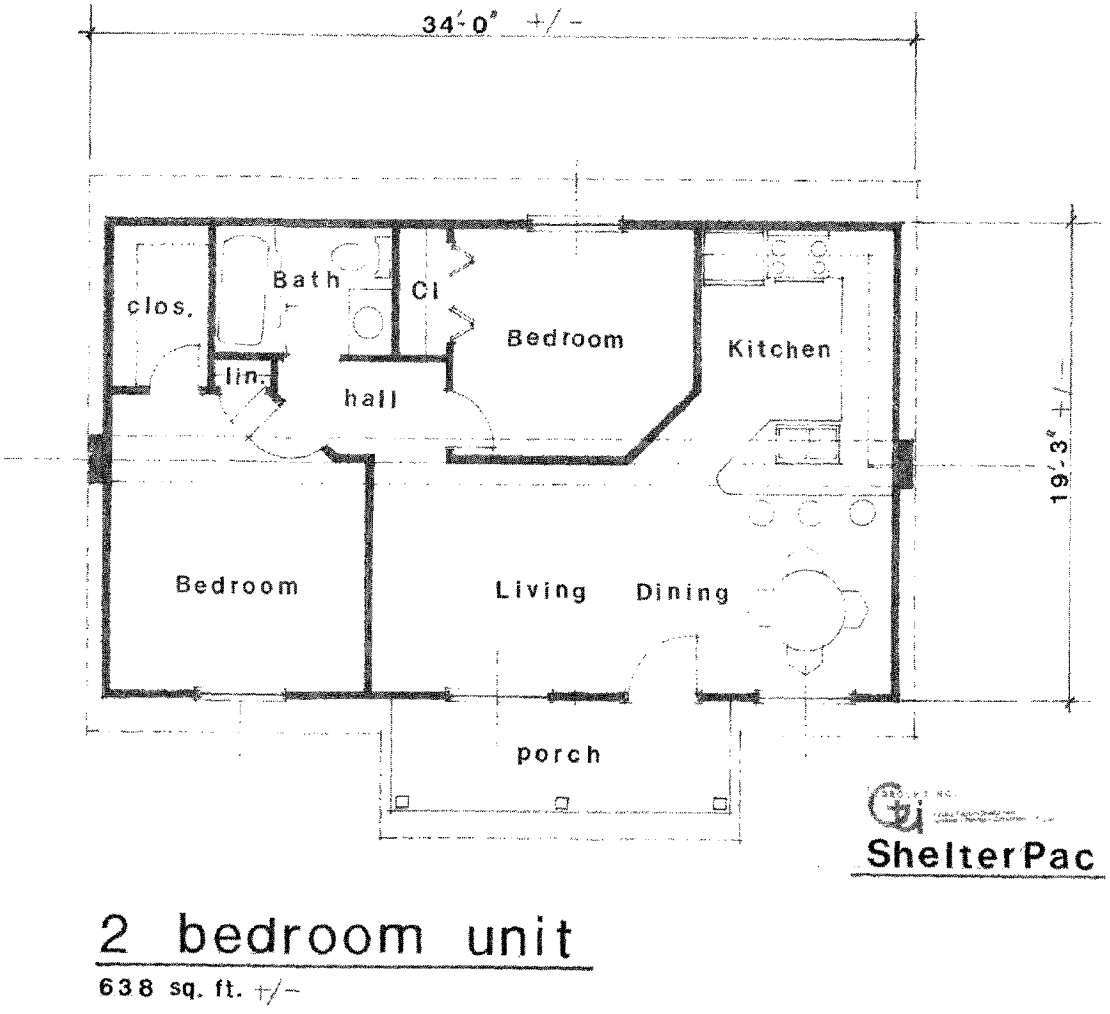
FIG. 12 illustrates another embodiment of the present invention showing a two bedroom unit.
Figure 13:
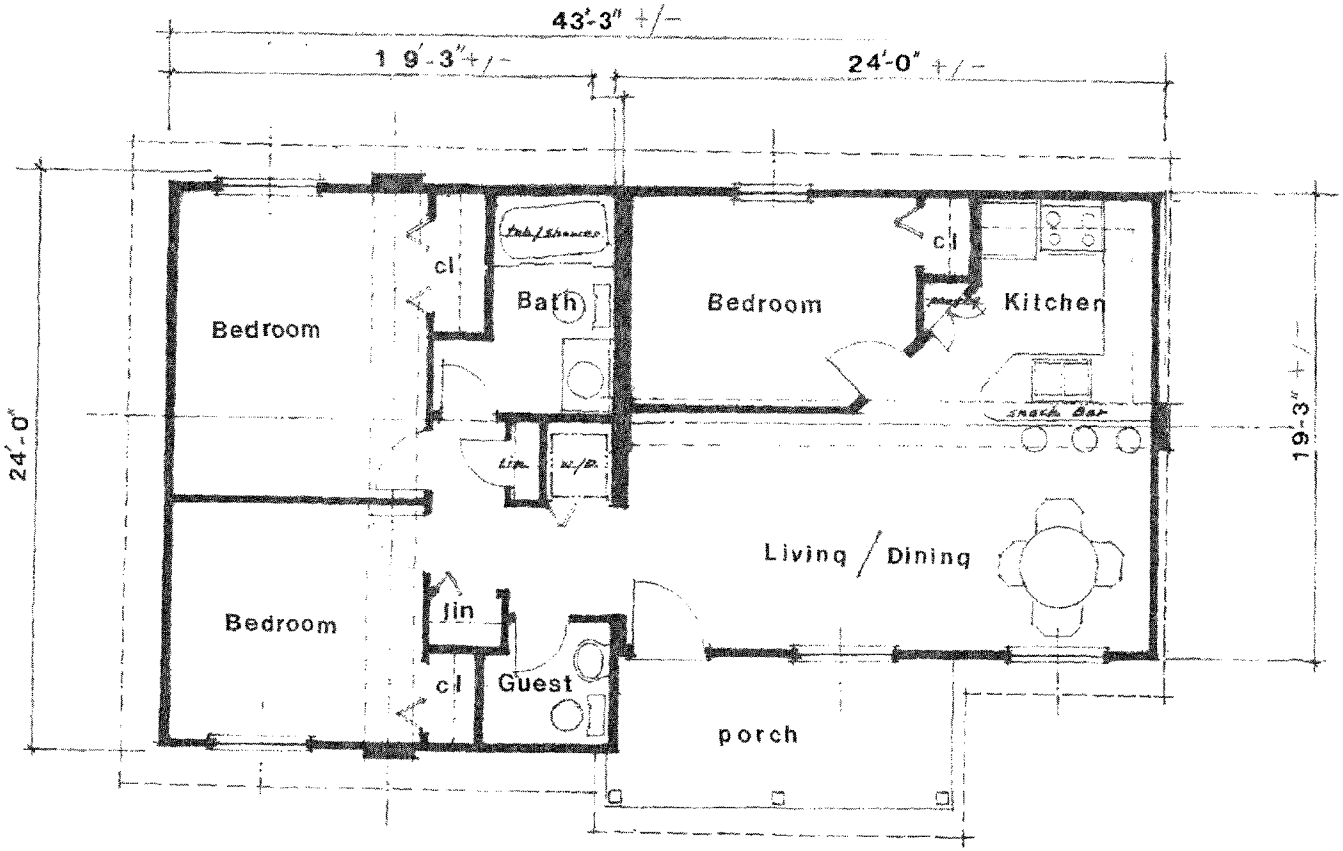
FIG. 13 illustrates another embodiment of the present invention showing a three bedroom unit.
Figure 14:
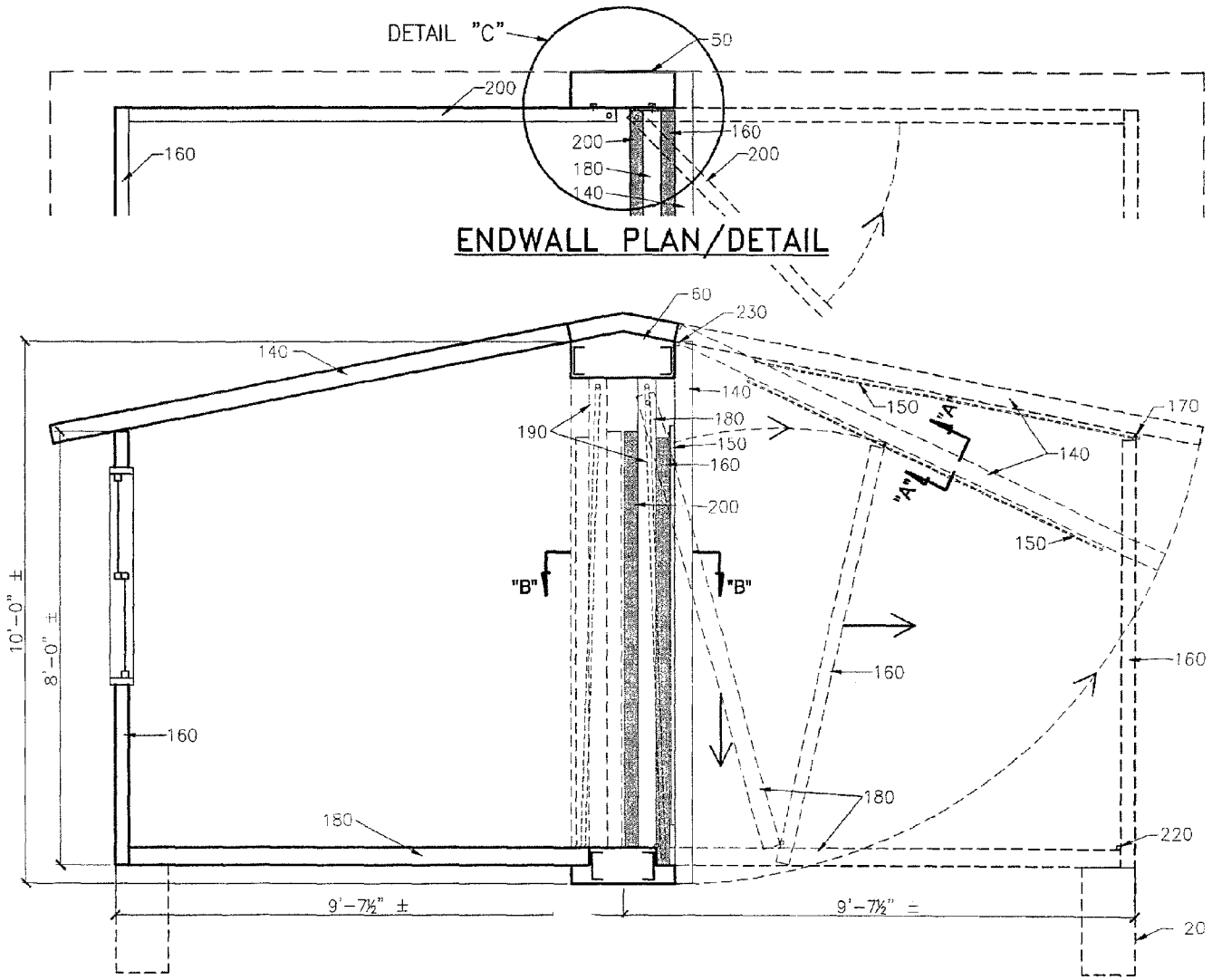
FIG. 14 illustrates a schematic cross section view of the unit stored in an unfolded-phase, indicating how the panels are unfolded in a sequential steps.
Figures 15, 16:
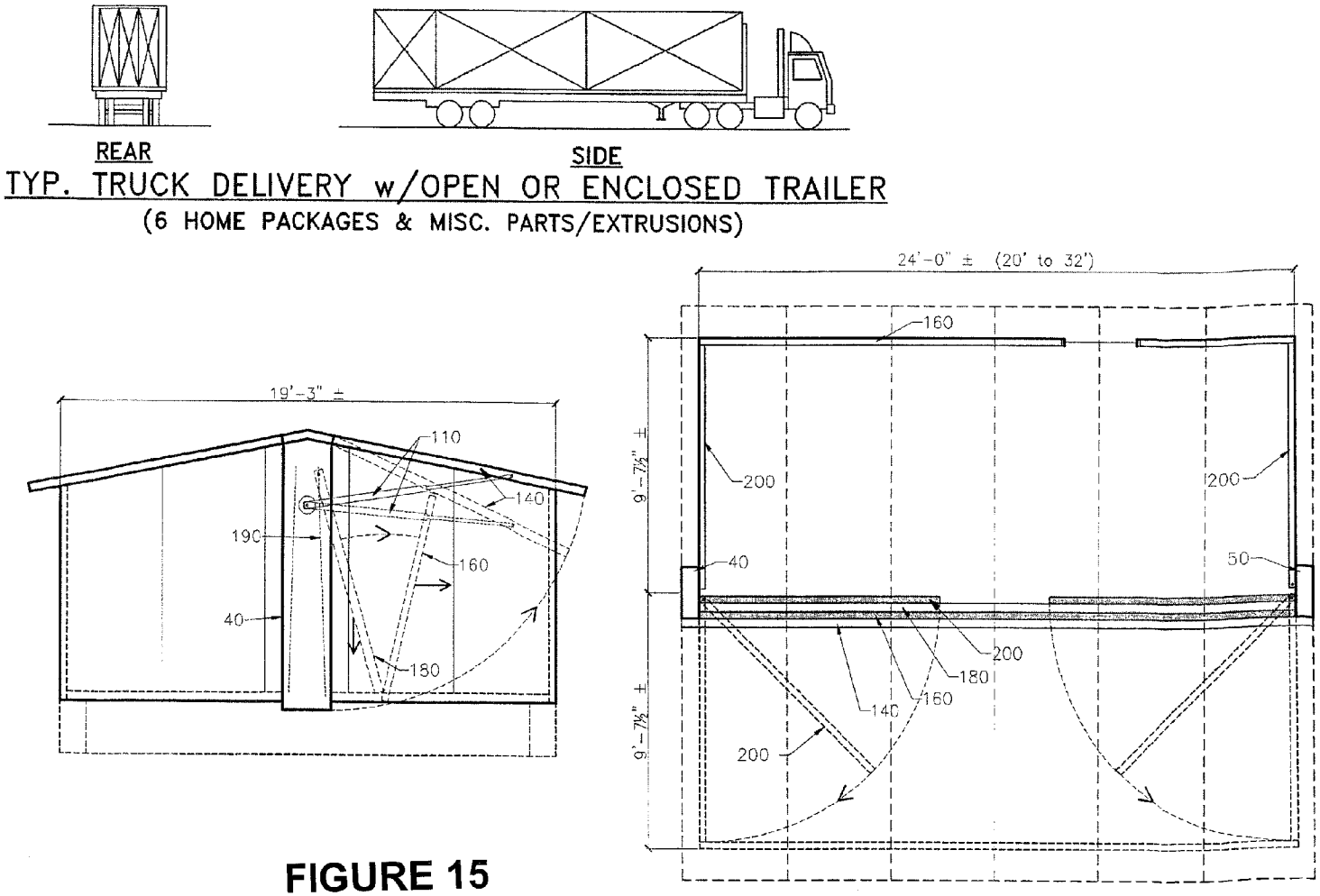
FIG. 15 illustrates a schematic side elevation view of the un-folding process of the panels.
FIG. 16 illustrates a schematic floor plan. Half of the plan showing the panels in storage phase and the other half showing the panels in the un-folding phase, and extended into the final set-up position.
Figure 17:
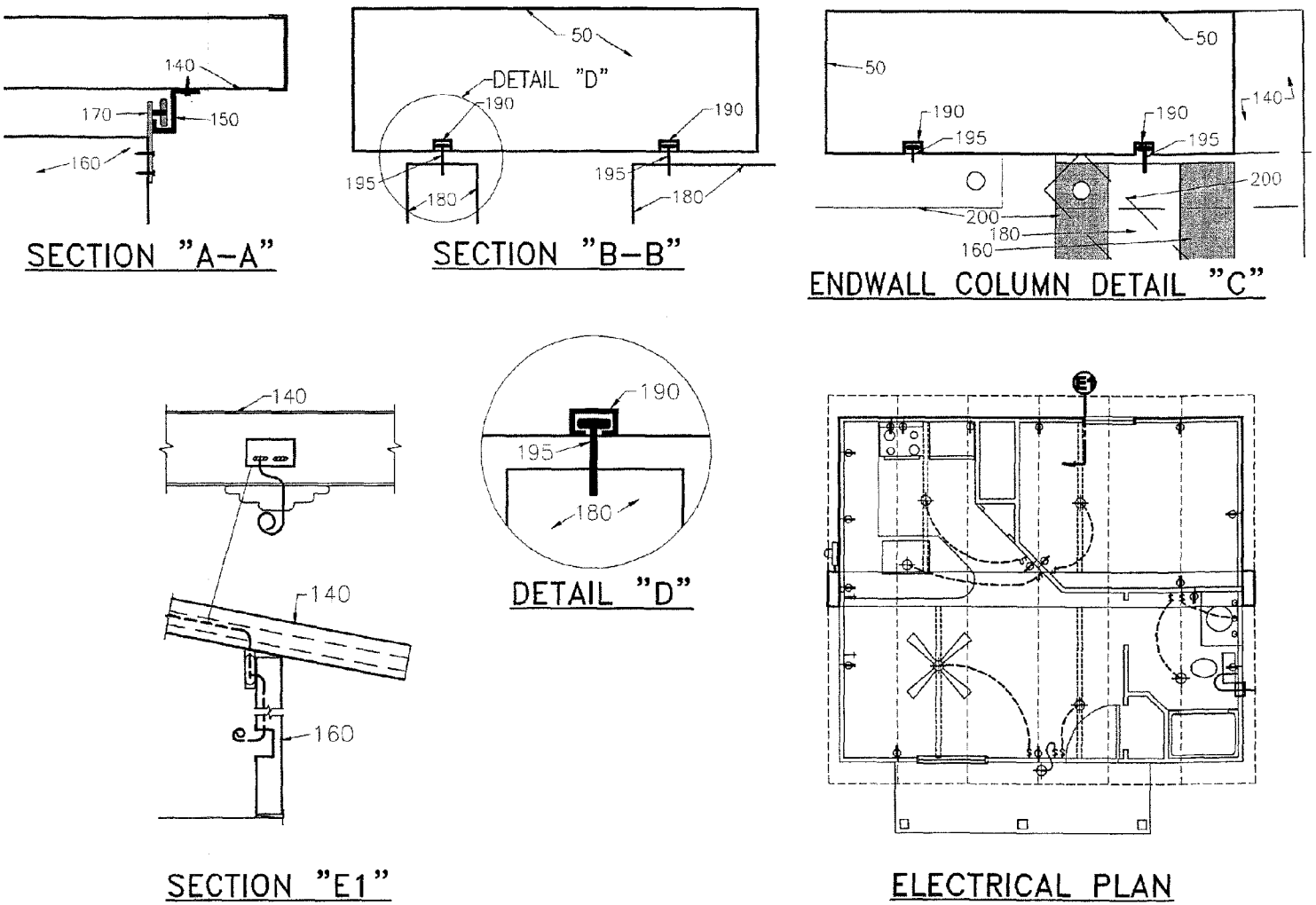
FIG. 17 illustrates a close-up view of the wiring system of the shelter or housing unit according to the present invention.

The present invention relates to a portable housing unit 10 to be placed on the ground foundation 20. The portable housing unit comprising:

a central frame 30 having a first end 40, a second end 50, a top side 60, a bottom side (not shown), and a hollow interior core 80 which creates a surrounding frame, wherein the first end and second end define opposing sides of the central frame 30;

a first section 90 attached to the top or the first end 60 of the central frame with a hinge pivot 230;

a second section 100 attached to the top or the second end 60 of the central frame with a hinge pivot 240;

a removable mechanical actuator 110 for unfolding the unit, wherein the mechanical actuator includes a first end 120 and a second end 130, wherein the first end 120 of the mechanical actuator is connected to the central frame 30;

wherein each of the first and second sections comprise:

a) a roof panel 140 hinge attached 230 to the central frame 60, wherein the roof panel includes guide rails 150 on each side extending along a majority of the length of said roof panel 140, wherein the second end 130 of the mechanical actuator is connected to the roof panel 140;

b) a side wall panel 160 connected to the roof panel 140, the side panel having a pivot roller 170 mounted on the guide rails 150 of the roof panel;

c) a floor panel 180 connected to the side wall by a continuous hinge 220 and connected to the central frame by means of a pivot roller 190 inserted into a guide rail, wherein the guide rails 190 are located on the central frame and the pivot roller 195 is located on the floor panel;

d) a pair of end panels 200 with pivots top and bottom connected to the central frame 30;

wherein the panels are stored within the volume of space 80 defined by the surrounding frame in the folded/stored position; and wherein the first section of the housing unit is unfolded on the ground or foundation by:

1) activating the mechanical actuator on the first section, which extends the roof panel outward causing the panel to swing upward (FIG. 4), the side wall to slide outward and down diagonally along the roof guide rails via pivot rollers (FIG. 5), then the floor panel slides downward and comes to rest horizontally on the ground or foundation (FIG. 6), then the pair of end panels swing out toward the sides and into the end wall position (FIGS. 7 and 8); and 2) switching the mechanical actuator to the second section and activating the mechanical actuator on the second section to repeat the process and create the second section.

At the manufacturing building the various panels are assembled into the central frame surround, with the central frame acting as a structural frame, the portable shipping container and the storage area for the remaining panels of the sections. Also, the central frame serves as the structural beam/column supports (lateral, up-lift, shear, and impact support) and also serves as a mechanical/electrical chase and also serves to store the electrical wires and mechanical ducting chase for the unit.

In another embodiment, the present invention contemplates replacing the hydraulic or pneumatic means by an external force such as physical manpower to un-fold the sections.

In this embodiment, the portable housing unit to be placed on a ground or foundation comprises:

a central frame having a first side, a second side, a top side, a bottom side, and a hollow interior core which creates a surrounding frame, wherein the first end and second end define opposing ends of the central frame;

a first section attached to the first side of the central frame;

a second section attached to the second side of the central frame;

an external force for unfolding the unit;

wherein each of the first and second sections comprise:

a) a roof panel hinge attached to the central frame, wherein the roof panel includes guide rails on each side extending along a majority of the length of said roof panel;

b) a side wall panel connected to the roof panel, the side panel having a pivot roller mounted to the guide rails of the roof panel;

c) a floor panel connected to the side wall by a continuous hinge and connected to the central frame by means of a pivot/guide rail system, wherein the guide rails are located on the central frame ends and the pivot roller is located on the floor panel;

d) a pair of end panels with pivots top and bottom connected to the central frame;

wherein the panels are stored within the volume of space defined by the surrounding frame in the folded/stored position; and wherein the first section of the housing unit is unfolded on the ground or foundation by:

1) applying the external force on the first section, which extends the roof panel outward causing the panel to swing upward, the side wall to slide outward and down horizontally along the roof guide rails via pivot rolls, then the floor panel slides downward and comes to rest horizontally on the ground or foundation, then the pair of end panels swing out toward the sides and into the end wall position; and 2) applying the external force to the second section and activating the mechanical actuator on the second section to repeat the process and create the second section.

Once assembled, in the manufactured building, the structure is loaded on a truck(s), shipping container(s), boat, rail, or other transporting means. Then, the structure is delivered to the desired destination.

The design of the portable shelter or housing unit, according to the present invention, in its folded form in the storage central frame container allows saving storage ground space compared to volume of modular units of the prior art. The unit may be stored at any appropriate location, including a warehouse, outdoors, or any location that may be convenient for fast mobilization centrally located.

Basically, the shelter or housing unit, according to the present invention, is delivered to the desired site by a transporting vehicle. The unit is lifted by means of a crane or similar device and set on the level ground or foundation.

When used as a temporary shelter, the container is delivered to the site, directly set on top of a leveled and compacted gravel and/or sand base. The aluminum skins of the floor panel along with the foam core provide the vapor barrier and thermal break necessary; thus, a simple base is required to support the unit. Anchoring can be done by means of corkscrew anchoring or concrete anchoring pads.

When used as a permanent housing unit, the folded shelter or housing unit, according to the present invention, contemplates the optional use of a concrete foundation or footing 20. The foundation or footing has pre-designed dimensions, thus the unit may be placed on top of it, and secured.

An alternate embodiment of the present invention for permanent housing contemplates setting the unit on top of square or round piers or pilings (not shown).

Interior Finishes

With the roof, panels, and floor in final placement, extruded channels, angles, miscellaneous extrusions, and miscellaneous fasteners are all screwed into final anchoring location, sealed, and made structurally sound and weather tight.

All the wiring, conduits, and outlet boxes are placed on the unit at the manufacturing plant. The main wire runs to be located in the central frame and secondary conduit chases in specified locations in the panel walls and floor. The main meter and breaker box are located in the end of the central frame. After the unit is set in the final unfolded position, then the wires can be run connected at the junction boxes at various panel joints or chases.

A small HVAC unit can be set on top of the roof and the air directed into the core or plenium area created in the central frame core and distributed to various diffusers located on the side and bottom of the top frame.

The panels can be made of any suitable material known in the art that provides a structure with enough strength to resist the changes in weather, wind load, and with weight an important design element to be considered.

In a preferable embodiment, the present invention contemplates the use of insulated panels (SIP), such as (EPS), expanded polystyrene cores with aluminum or galvalume outer skins. These types of panels are designed to hold up against nature's toughest challenges and provide for this structural integrity.

The use of these types of panels allows for the production of a lightweight, structurally sound, mold resistant, moisture resistant, high "R" value, termite resistant, pre-finished shelter, at a low cost and also is environmentally friendly (green design) and recyclable.

Plumbing lines, water and sanitary, are placed in or under the floor panel and extended up through the floor panel and into floor mounted water closets (floor outlets pre-plumbed), lavatories and sinks (via vanity and kitchen cabinets). Shower piping can be mounted to the panel and in a chase area formed by the fiberglass walls of the shower unit.

The main ducts for the heating, air conditioning, and ventilation systems are installed in the central frame and run to outlets dispensers along the side and bottom of the central frame.

Interior finishes to the panels can optionally be added to the unit after the basic unit is set up.

The aluminum (pre-finished) stipple or wood grain texture finish can be left exposed or additional finish material can be field-applied such as painting drywall, paneling, doors, cabinets, shelving, floor covering, and/or any other interior finishing.

Exterior Finishes

The aluminum (pre-finished) stipple or wood grain texture finish can be left exposed or additional wall finishes can be applied, such as vinyl siding, stucco, or other material suitable for exterior exposure and fenestration.

FIG. 10 shows the unit having a small shed roof porch, synthetic stucco, tile roofing, and trims to customize the unit, as to conform the unit to similar looking units in a housing development. In addition, other materials such as, vinyl siding, vinyl shingles, asphalt shingles, and/or metal roof, can be added to the unit.

The doors and windows can be applied to the side panels or end panels as required at the manufacturing plant and is part of the package; thus adding to a weather tight shell when first set up.

Roof/Façade

The aluminum (pre-finished) SIP panels with a stipple finish can be left exposed with the appropriate flashings, façade, or field-applied.

The present invention provides a foldable structure which is readily adaptable to a variety of uses and floor plans. In addition, the present invention provides a foldable structure in a small container which is easily transported over most roads without the hazards and expenses of the prior art that transport building of volume. The housing unit of the present invention can be transported to remote locations with minimal or no access roads such as mountainous areas, wooded areas and long distance regions. In addition, the present invention can be lifted by helicopters.

What is claimed is:

1. A portable housing unit to be placed on a ground or foundation, the portable housing unit comprising:

a central container frame located in the center of the housing unit, the central container frame having a first side, a second side, a top side, a bottom side, an inside face, and a hollow interior core which creates a surrounding frame, wherein the first side and second side define opposing sides of the central container frame, wherein the inside face includes a right side and a left side, wherein the central container frame includes vertical guide rails mounted to the right side and the left side of the inside face running vertically from top to bottom;

a first section attached to the first side of the central container frame;

a second section attached to the second side of the central container frame;

a removable mechanical actuator for unfolding the first section and the second section from the central container frame, wherein the mechanical actuator includes a first end and a second end;

wherein each one of the first section and the second section comprises:

a) a roof panel having top and bottom sides, upper, lower, right, and left sides, guide rails located on the bottom side of the roof panel, wherein the guide rails extend from the upper side to the lower side of the roof panel, a hinge located at the upper side of the roof panel and connected to the central container frame, wherein the lower side of the roof panel is connected to a side wall panel when the side wall is fully extended;

b) the side wall panel having top and bottom sides, and upper, lower left and right surrounding sides, pivot rollers mounted to the top right and left sides of the side panel, wherein the pivot rollers are inserted into the guide rails mounted to the bottom of the roof panel, wherein the pivot rollers slide along the guide rails from the upper end of the roof panel to the lower end of the roof panel during the un-folding of the housing unit;

c) a floor panel having top and bottom sides, upper, lower, and right and left surrounding sides, pivot rollers mounted to the right and left sides, wherein the pivot rollers are inserted into the guide rails located on the right and left inside face of the container frame, wherein the pivot rollers of the floor panel slide along the vertical guide rails vertically from the top of the guide rails to the bottom of the guide rails during the unfolding process of the housing unit;

d) a pair of end panels having top and bottom sides, pivots mounted to the top and bottom sides, wherein the pivots of the end panels are pivotally connected to the upper and lower inside face of the central container frame;

wherein the first end of the mechanical actuator is connected to the central container frame and the second end is connected to the roof panel;

wherein all of the panels are stored within the volume of space defined by the surrounding frame of the central container frame; and wherein each section of the housing unit is unfolded from the central container frame on the ground or foundation by activating the mechanical actuator on one of the sections, which extends the roof panel outward and upward, causing the pivot rollers of the side wall panel to slide along the guide rails mounted to the bottom of the roof panel, wherein the side wall panel unfolds diagonally and downward from the central container until it reaches a certain point where it then pulls the floor panel from the container frame, the floor panel pivots as it slides downward along the guide rails mounted on the inside face of the central container sides until it comes to rest at the bottom of the container frame, as the floor panel slides downward it also pushes the side wall panel into a vertical position until it comes to rest vertically at right angles to the roof panel, wherein the end panels are rotated outward from the container frame until in final position sandwiched in between the roof, floor, sidewall, and the central container frame, wherein the housing unit is totally enclosed by the surrounding roof, floor, floor, side walls, and end panels.

2. The folded housing unit according to claim 1 wherein the mechanical actuator is a hydraulic or pneumatic device.

3. The folded housing unit according to claim 1 further comprising doors and windows installed in the side panel and/or the end panels.

4. The folded housing unit according to claim 1, further comprising a temporary gripping means mounted to the top side of the central container frame.

5. The folded housing unit according to claim 1 further comprising a second folding housing unit connected to the first folding housing unit.

6. The folded housing unit according to claim 1, wherein in the folded position, the central container frame is from about 21" to 30" wide, about 108" to 144" high and about 20' to 32' long.

* * * * *